US007455429B2

(12) United States Patent
Barker

(10) Patent No.: US 7,455,429 B2
(45) Date of Patent: Nov. 25, 2008

(54) DISPLAY SYSTEM COVER

(75) Inventor: Tom Barker, London (GB)

(73) Assignee: Smartslab Limited, London (GB)

( * ) Notice: Subject to any disclaimer, the term of this patent is extended or adjusted under 35 U.S.C. 154(b) by 398 days.

(21) Appl. No.: 10/534,167

(22) PCT Filed: Nov. 3, 2003

(86) PCT No.: PCT/GB03/04770

§ 371 (c)(1),
(2), (4) Date: May 5, 2005

(87) PCT Pub. No.: WO2004/042679

PCT Pub. Date: May 21, 2004

(65) Prior Publication Data

US 2006/0168853 A1 Aug. 3, 2006

(30) Foreign Application Priority Data

Nov. 5, 2002 (GB) ..... 0225773.1

(51) Int. Cl.
*G09F 11/12* (2006.01)

(52) U.S. Cl. ..... 362/290; 40/524

(58) Field of Classification Search ..... 362/290–293, 362/354, 812; 40/427, 442, 541, 550, 551, 40/564

See application file for complete search history.

(56) References Cited

U.S. PATENT DOCUMENTS 3,194,954 A * 7/1965 Locke ..... 362/290
4,254,453 A 3/1981 Hamby
4,271,408 A * 6/1981 Teshima et al. ..... 345/83
4,603,496 A * 8/1986 Latz et al. ..... 40/547
4,628,422 A * 12/1986 Ewald ..... 362/240
4,754,202 A * 6/1988 Havel ..... 315/169.1
5,164,715 A * 11/1992 Kashiwabara et al. ..... 345/4
5,647,152 A * 7/1997 Miura ..... 40/541
5,873,645 A * 2/1999 Belfer ..... 362/551
5,924,785 A * 7/1999 Zhang et al. ..... 362/241

FOREIGN PATENT DOCUMENTS

| | | | |
|---|---|---|---|
| DE | 100 06 164 | | 9/2000 |
| FR | 2563929 | A * | 11/1985 |
| GB | 1 491 142 | | 11/1977 |
| GB | 2366900 | | 3/2002 |
| WO | WO 89 08304 | | 9/1989 |
| WO | WO 95 18435 | | 10/1996 |

* cited by examiner

*Primary Examiner*—Hargobind S Sawhney
(74) *Attorney, Agent, or Firm*—Luedeka, Neely & Graham, P.C.

(57) ABSTRACT

An assembly (16) for covering a visual display means (10) which has an array of pixels (12) is described. The assembly (16) comprises an array of cells (18) with reflective walls and an opening at each end. A transparent cover sheet (20) is positioned adjacent the open end of the cells (18) on one side of the array. The array is dimensioned such as in use each cell (18) is aligned with one pixel (12) of the visual display means (10). In this way, large visual display systems with excellent optical performance can be provided which can be used both internally and externally and are capable of bearing loads and forming structural members.

14 Claims, 3 Drawing Sheets

DISPLAY SYSTEM COVER

CROSS REFERENCES TO RELATED APPLICATIONS

This patent application claims priority from and is related to Patent Cooperation Treaty (PCT) patent application Serial No. PCT/GB2003/004770 filed 5 Nov. 2003, entitled: "Display System Cover." This patent application also claims priority from and is also related to Great Britain Patent Application Serial No. 0225773.1 filed 5 Nov. 2002, entitled: "Display System Cover." These related Patent Applications are incorporated by reference in their entirety herein.

FIELD

The present invention relates to an assembly for covering a visual display system which improves the optical and physical performance of the system.

BACKGROUND

It is known to provide visual displays made up of an array of pixels, with each pixel being created by a light source such as an LED or the end face of an optical fibre. Such visual displays can be used for informational signage, advertising, relaying TV pictures, art installations and so on. However, such displays suffer from a number of disadvantages. The angle at which the screen can be viewed and the distance from which it can be viewed in order to see a reasonably coherent and legible image are relatively limited. The optical performance and legibility even when viewed within the preferred ranges is not particularly great since the image tends to appear as dots of colour on a black background. The visual displays require additional modification, at great expense, in order to make them weatherproof for use outdoors and such systems have limited loadbearing capacities and cannot be used as structural members.

It is also known to use an array of CRT, plasma or LCD screens covered by thick glass sheets produce a large display. However, the size is still limited and the overall image produced is disrupted by the relatively thick edges to the individual TV screens.

SUMMARY

In one embodiment the present invention provides an assembly for covering a visual display having an array of pixels. The assembly includes an array of cells with reflective walls and an opening at each end. There is also a transparent cover sheet adjacent the open ends of the cells on one side of the array. The array is dimensioned such that in use each cell is aligned with one pixel of the visual display.

Another embodiment provides a visual display system that includes a visual display having an array of pixels. A cover assembly is secured to the visual display. The cover assembly has an array of cells with reflective walls and an opening at each end. The cover assembly also has a transparent cover sheet adjacent the open ends of the cells on one side of the array, the array of cells being configured such that each cell is aligned with one pixel of the visual display and configured such that the array of cells is sandwiched between the cover sheet and the visual display.

A further embodiment provides a digital visual display system having a plurality of discrete light sources arranged in a plurality of rows, wherein the light sources in each row are offset with respect to the light source in each adjacent row.

DETAILED DESCRIPTION

The present invention provides an assembly for covering a visual display means which has an array of pixels, the assembly comprising an array of cells with reflective walls and an opening at each end, and a transparent cover sheet adjacent the open end of the cells on one side of the array, wherein the array is dimensioned such that in use each cell is aligned with one pixel of the visual display means.

Preferably, the cells are contiguous and may be in the form of open ended tubes. In a preferred embodiment, the cells are formed from a honeycomb mesh of adjacent hexagonal cells. Alternatively, the cells may be formed by a mesh with substantially square apertures. In a further alternative, each cell may comprise a parabolic reflector with an opening in the centre of the base for alignment with a pixel of the visual display means. In a further alternative, each cell may comprise a light guide.

The walls of the cells may be provided with a surface treatment to increase reflectivity.

Additionally, a lens may be provided in each cell to capture substantially all of the light from the pixel.

The cover sheet preferably comprises glass or plastic. The assembly may also comprise a bottom sheet to create a load bearing structure and may also provide a weather proofing capability to protect the visual display means.

To improve the optical performance, the cover sheet may be moulded to form a lens aligned with each cell of the array. The cover sheet may also have a surface treatment applied to improve the optical characteristics.

Further option to improve the optical performance is to include lens means between the array of cells and the cover sheet, aligned with the walls of the cells, to allow diffusion of light between adjacent cells. The lens means may be in the form of adhesive used between the cells and the cover sheet.

The present invention also provides a visual display system comprising an assembly as described above secured to a visual display means having an array of pixels, such that the array of cells is sandwiched between the cover sheet and the visual display means.

In another aspect, the present invention provides a digital visual display system comprising a plurality of discrete light sources arranged in a plurality of rows, wherein the light sources in each row are offset with respect to the light sources in each adjacent row.

The invention will now be described in detail, by way of example only, with reference to the accompanying drawings in which.

Figure 1:
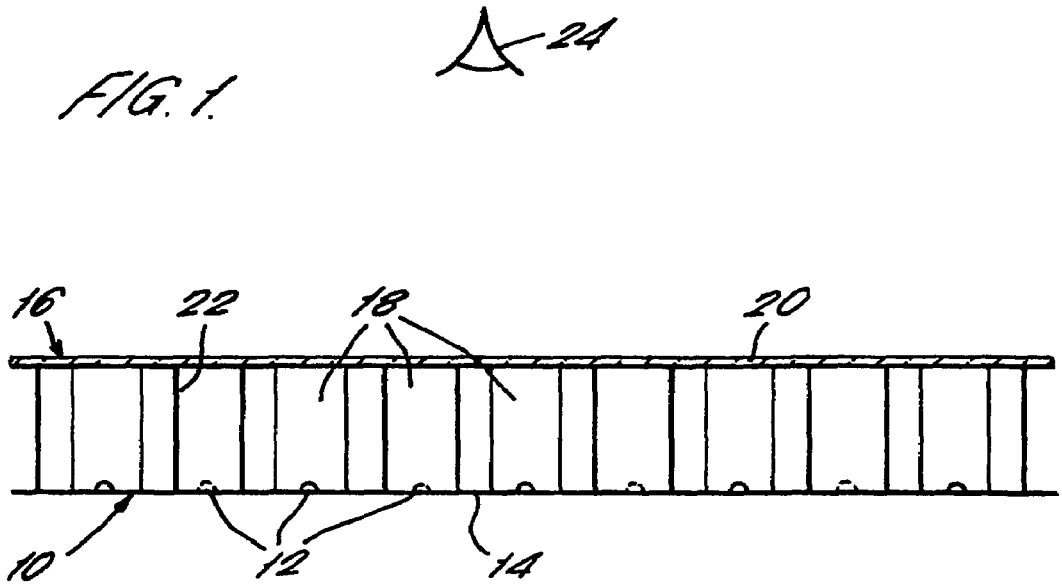
FIG. 1 is a schematic cross sectional view of part of a first embodiment of the present invention in combination with a visual display means, along the line A-A in FIG. 2.

FIG. 1 is a cross section through a first embodiment of the present invention in combination with a visual display means. The visual display means 10 is of the dot-matrix (or digital) type, that is it comprises an array of pixels 12 each of which is formed by a light source such as an LED or the end of an optical fibre. The pixels 12 are mounted on a backing element 14 as is well known in the art.

The assembly 16 of the present invention comprises an array of cells 18 adjacent a transparent cover sheet 20. The walls 22 of the cells 18 are formed by a honeycomb mesh creating contiguous hexagonal cells as best seen in the plan view of FIG. 2. The cells 18 are thus open at each end. The honeycomb mesh is typically formed of a material such as aluminium, thus making the walls 22 of the cells 18 reflective.

The array of cells 18 is dimensioned so that the assembly can be fitted over the visual display means 10 with each pixel 12 aligned with the centre of one cell 18. Thus, light from each pixel 12 passes through a cell 18 and can be observed through the transparent top sheet 20 by an observer 24. Reflection from the walls 22 of the cells 18 helps to optimise the amount of light transmitted through the cells 18, thereby enhancing the brightness of the image seen by the observer 24. The walls 22 may have a surface treatment to improve their reflectivity. Additionally, lenses (not shown) may be incorporated into each cell 18 to capture substantially all of the light from each pixel 12.

Employing the assembly 16 of the present invention in combination with a visual display means 10 provides a number of benefits. First, in terms of optical performance, internal reflection within each cell 18 means that the cells 18 are flooded with light. This in turn means the image seen by the observer 24 comprises blocks of solid colour rather than dots of colour on a black background.

In addition, the viewing angle and viewing distance ranges are increased. Thus, an observer may view the display from a greater range of angles and from a greater range of distances and still see a coherent and legible image.

A further advantage is that the top sheet 20 may be designed to provide structural performance, when combined with a bottom perforated sheet, to the whole display unit, i.e. it may be a load bearing element, allowing the unit to be used to create or form part of a floor or wall structure.

The top sheet 20 may also provide a weatherproofing function, allowing the display system to be used externally without further modification to the visual display means 10 itself.

The top sheet 20 may also be adapted to further enhance the optical performance by means of surface treatments and/or it may be moulded to form lenses (not shown) aligned with each cell 18 of the array to improve the light output.

Figure 2:
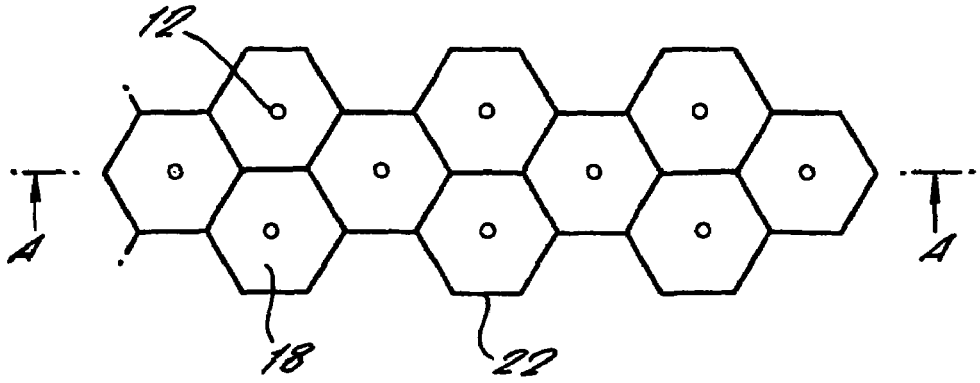
FIG. 2 is a schematic plan view of part of the first embodiment shown in FIG. 1.
Figure 3:
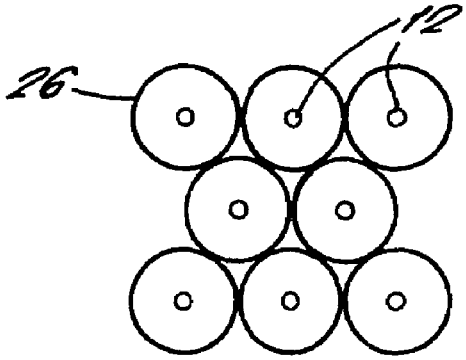
FIG. 3 is a schematic plan view of part of a second embodiment of the present invention.
Figure 4:
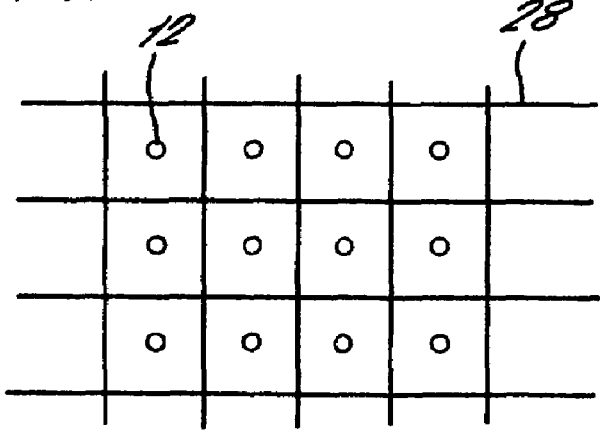
FIG. 4 is a schematic plan view of part of a third embodiment of the present invention.
Figure 6:
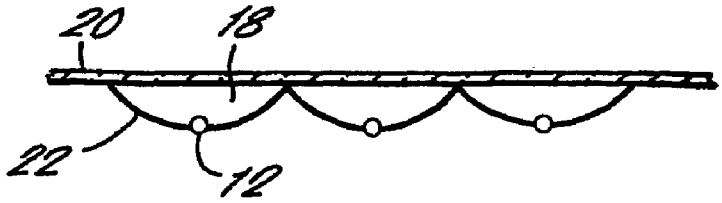
FIG. 6 is a schematic cross sectional view through part of a fifth embodiment of the present invention.
Figure 5:
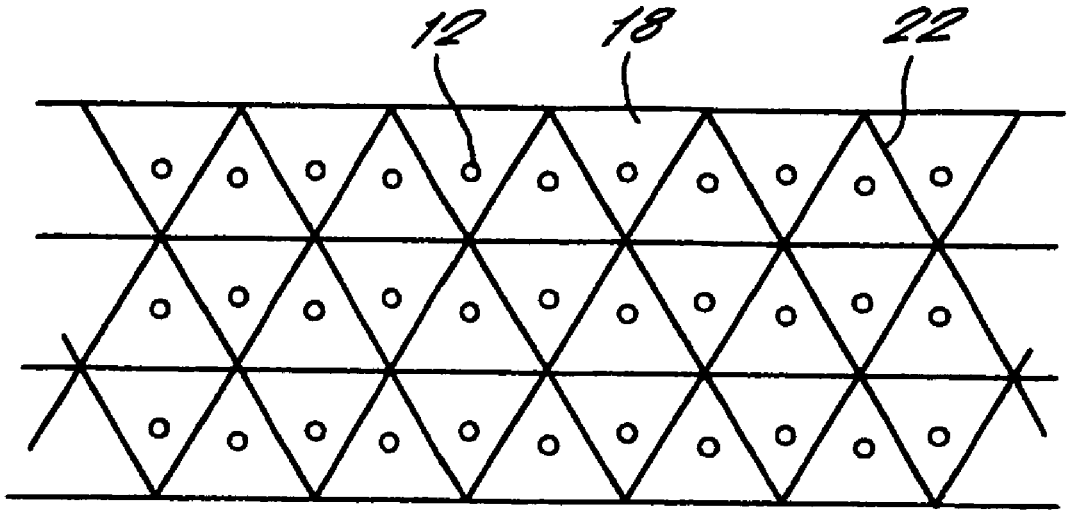
FIG. 5 is a schematic plan view of part of a fifth embodiment of the present invention.

The cells 18 need not be hexagonal cells of a honeycomb structure as illustrated in FIGS. 1 and 2. The cells 18 may instead be formed of cylindrical tubes 26, packed together as illustrated in FIG. 3. Alternatively, a mesh 28 with substantially square apertures could be used as shown in FIG. 4. Another arrangement is an array of equilateral triangles as seen in FIG. 5. Another option is for each cell 18 to be in the form of a parabolic reflector as seen in FIG. 6, having an opening in the centre of the base of each parabola to receive the pixel 12.

Figure 7:
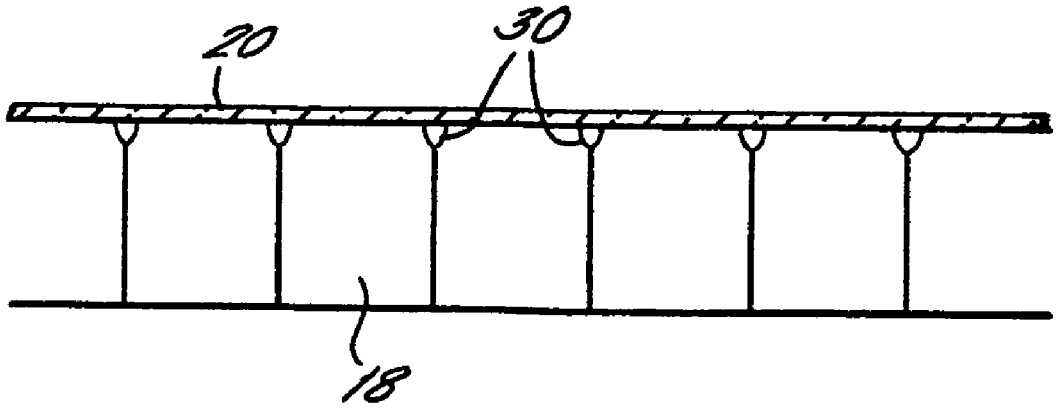
FIG. 7 is a schematic cross sectional view of a further feature of the invention, applicable to all of the embodiments.

In some circumstances it is desirable to have some diffusion of light between adjacent pixels. This enables the improved rendering of images which have smooth edged forms or soft colour graduations. In order to allow for some diffusion between adjacent pixels, one option is to provide a form of lens (30) on the top of the walls 22 of the cells 18, extending between the walls 22 and the cover sheet 20. This is illustrated in FIG. 7. This network of lenses may be created as a separate part to be included in the assembly or may be formed by using a liquid adhesive, which sets into a light transmitting bead between the cells 18 and the cover sheet 20. This arrangement may be incorporated in any of the embodiments described.

A further possibility is to form each cell 18 as a light guide such as a solid glass or plastic element with a plane face at each end, which allows substantially all the incident light to pass through without reflection, constituting the "open ends" of the cell. The side walls of the light guide which join these end faces, however, provide for substantially total internal reflection so that all the light entering the light guide is transmitted through it and out of the opposing end face.

It will be apparent from these examples of cells 18 are not exhaustive and other possibilities exist.

As described above, the arrangement of pixels 12 and the shape and arrangement of the overlying cells 18 can take a variety of forms. In particular, the pixels 12 may be arranged in a square grid as shown in FIGS. 4 and 5 in which the pixels are in rows with the pixels in each row being aligned with the pixels in each adjacent row. Alternatively, the pixels 12 may be in an offset arrangement with the pixels in each row being offset with respect to the pixels in each adjacent row as in FIGS. 2 and 3. In some applications, this offset arrangement is preferred since each pixel 12 has a greater number of equidistant neighbouring pixels 12. In the arrangements of FIGS. 2 and 3, each pixel 12 will be equidistant from 6 neighbouring pixels 12. However, with the arrangement of FIGS. 4 and 5 each pixel has only four equidistant neighbours closest to it. The offset arrangement, with each pixel having a greater number of equidistant neighbours, allows improved mapping of images onto the display and this results in images of better effective resolution to the observer.

Thus, the present invention makes it possible to provide large visual display systems with excellent optical performance which are useable both internally and externally and are capable of bearing loads and forming structural members. It will be apparent that a number of variations and modifications to the precise details described herein are possible, without departing from the scope of the invention are set out in the claims.

The invention claimed is:

1. An assembly for covering a visual display having an array of pixels, the assembly comprising:

an array of cells with reflective walls and an opening at each end, wherein the array is dimensioned such that each cell is aligned with one pixel of the visual display;

a lens arranged between the array of cells and the cover sheet, aligned with the walls of the cells, operable to diffuse light between adjacent cells;

a transparent cover sheet adjacent the open ends of the cells on one side of the array; and a bottom sheet adjacent the open ends of the cells on the other side of the array, wherein the array of cells, the cover sheet and the bottom sheet are configured as a load bearing element.

2. An assembly as claimed in claim 1, wherein the cells are contiguous.

3. An assembly as claimed in claim 1, wherein each cell comprises a tube open at each end.

4. An assembly as claimed in claim 1, wherein the array comprises a honeycomb mesh creating adjacent hexagonal cells.

5. An assembly as claimed in claim 1 wherein the array comprises a mesh with substantially square apertures.

6. An assembly as claimed in claim 1, wherein each cell comprises a parabolic reflector having an opening in the centre of the base for alignment with one pixel.

7. An assembly as claimed in claim 1, wherein each cell comprises a light guide.

8. An assembly as claimed in claim 1 wherein the walls of the cells are provided with a surface treatment to increase their reflectivity.

9. An assembly as claimed in claim 1 further comprising a lens in each cell.

10. An assembly as claimed in claim 1, wherein the cover sheet comprises glass or plastic.

11. An assembly as claimed in-claim 1, wherein the cover sheet provides weather proofing to the visual display.

12. An assembly as claimed in claim 1, wherein the cover sheet is shaped to form a lens aligned with each cell of the array.

13. An assembly as claimed in-claim 1, wherein the cover sheet is provided with a surface treatment to improve the optical performance.

14. An assembly as claimed in claim 1, wherein the lens is provided by adhesive between the cells and the cover sheet.

* * * * *

UNITED STATES PATENT AND TRADEMARK OFFICE

CERTIFICATE OF CORRECTION

PATENT NO. : 7,455,429 B2
APPLICATION NO. : 10/534167
DATED : November 25, 2008
INVENTOR(S) : Tom Barker It is certified that error appears in the above-identified patent and that said Letters Patent is hereby corrected as shown below:

On the cover page item [30], the International Filing Date of "Nov. 3, 2003" should be changed to --Nov. 5, 2003--.

Signed and Sealed this

Twenty-fourth Day of February, 2009

JOHN DOLL
*Acting Director of the United States Patent and Trademark Office*